US005301697A

United States Patent [19]

Gueret

[11] Patent Number: 5,301,697

[45] Date of Patent: Apr. 12, 1994

[54] MANUFACTURE PROCESS FOR APPLICATOR ASSEMBLY CONTAINING A SMALL AMOUNT OF MAKE-UP PRODUCT AND CORRESPONDING APPLICATOR ASSEMBLY

[75] Inventor: Jean-Louis H. Gueret, Paris, France

[73] Assignee: L'Oreal, Paris, France

[21] Appl. No.: 109,460

[22] Filed: Aug. 20, 1993

Related U.S. Application Data

[63] Continuation of Ser. No. 917,325, Jul. 23, 1992, abandoned.

[30] Foreign Application Priority Data

Jul. 29, 1991 [FR] France ..... 91 09587

[51] Int. Cl.[5] ..... A45D 27/22; B65D 69/00

[52] U.S. Cl. ..... 132/298; 132/317; 132/293; 206/823; 206/581

[58] Field of Search ..... 132/320, 293, 294, 298, 132/317, 200; 206/581, 823

[56] References Cited

U.S. PATENT DOCUMENTS

| | | | |
|---|---|---|---|
| 2,358,270 | 9/1944 | Wild | 206/823 |
| 2,656,090 | 10/1953 | Hamlet | 206/823 |
| 3,871,390 | 3/1975 | Spatz | 132/293 |
| 4,962,626 | 10/1990 | Gueret | 53/412 |
| 5,031,647 | 7/1991 | Seidler | 132/320 |
| 5,109,879 | 5/1992 | Seidler | 132/320 |

FOREIGN PATENT DOCUMENTS

| | | |
|---|---|---|
| 0252001 | 1/1988 | European Pat. Off. . |
| 0310471 | 4/1989 | European Pat. Off. . |
| 2535588 | 11/1984 | France . |
| 2651708 | 12/1988 | France . |
| 2205744 | 12/1988 | United Kingdom . |
| 8808679 | 11/1988 | World Int. Prop. O. . |

*Primary Examiner*—John G. Weiss

*Attorney, Agent, or Firm*—Cushman, Darby & Cushman

[57] ABSTRACT

An applicator assembly includes a cradle in which there is provided a support having a stem and a pallet and with the cradle having an imprint including a groove and a recess for receiving, respectively, the stem and the pallet with the recess having been provided with the cosmetic product prior to insertion of the pallet into the recess; pressure is exerted on the at least the pallet to force the pallet into contact with the cosmetic product in the recess so that the pallet will take up at least a portion of the cosmetic product when the pallet is removed from the recess.

17 Claims, 1 Drawing Sheet

MANUFACTURE PROCESS FOR APPLICATOR ASSEMBLY CONTAINING A SMALL AMOUNT OF MAKE-UP PRODUCT AND CORRESPONDING APPLICATOR ASSEMBLY

This is a continuation of application Ser. No. 07/917,325, filed on Jul. 23, 1992, which is now abandoned.

BACKGROUND OF THE INVENTION

Field of the Invention

The invention concerns an applicator assembly containing a small amount of make-up product. The term small amount implies here an amount allowing a test application or a single application of the make-up product. The invention thus essentially concerns an applicator assembly which can be distributed as a sample and is not re-usable.

Description of the Prior Art

The use of make-up product applicators for a single application is known; these applicators consist of a retention means comprising a stick on the free end of which is placed a small quantity of the make-up product. The product is protected from the outside before use, by means of a cap covering the stick and the product thus carried, and secured to the retention means connected to the stick. In this arrangement, the make-up product has effective external protectection, though the protective cap generally has to be fitted manually and in any case, its removal before use risks deterioration of the amount of make-up product on the end of the stick.

French patent 2 535 588 proposes simpler means, by way of a sleeve containing a number of applicators placed side by side, the assembly being approximately as for book matches. The free end of each applicator in the form of a match is covered with make-up product. This particular arrangement is of much more reasonable self-cost than the previous one, bearing in mind the fact that each applicator is not associated with a protective cap. However it is also true that when a sleeve of applicators has been started, the user cannot know if the applicator newly selected from the sleeve has already been used or not. This less expensive arrangement is therefore not entirely satisfactory.

SUMMARY OF THE INVENTION

According to the invention, it has been found that sufficient product for a test application, or a single application of a paste or powder product, is retained on a support, by simply exerting pressure, thus simplifying manufacture of applicators of this type. The invention also has the advantage of allowing an applicator assembly for distribution to be obtained immediately after placing the product on the support, which is secured in a cradle and forms a protective cover for the amount of make-up product to be used.

The first aim of the invention is a manufacturing process for an applicator assembly for a powder or paste make-up product P, the said applicator assembly comprising a support on which the product P is affixed by pressure, characterised in that the product P is placed in a hollow print formed in a cradle, the support being placed on the product P within the print, the cradle bearing the support being placed on a platten, the face without print bearing on the said platten, and in exerting pressure on the support / cradle assembly, to insert the support into the cradle print and secure to the support at least part of the product P contained in the print.

Pressure-securing of product P leads to a greater or lesser amount of product P being affixed, depending respectively of course on the more or less smooth nature of the cradle and support materials, with the possibility of part of the product being affixed to the cradle at the bottom of the print.

A second aim of the invention is an applicator assembly obtained by the process described above.

In this applicator assembly the part of the support intended to bear product P may be partly flocked to facilitate keying of the product P.

The cradle may be of any given shape, for instance round, oval, square or rectangular and may comprise a number of prints and associated supports.

The cradle may be plastic or cardboard material. In case of cardboard the support print can be obtained by pressing the board or by affixing two sheets of board to each other, at least one board being cut to form the print. The uncut sheet can be a simple sheet of thin paper. The cradle and/or support may be at least partly transparent so as to show the colour of product P.

The print will have preferably at one end a selection recess allowing the support to be grasped to remove it from the print.

Product P consists of any mixture of organic or inorganic materials intended for make-up, for instance on the skin of the face and eyelids. Among the inorganic products can be cited talc, clay such as kaolin more particularly, mica and inorganic pigments, for instance oxides of titanium, zinc or iron. Among the organic products can be cited vegetable powders, such as rice starch or silk powder, powders of nonthermoplastic polymers such as polyacrylates and fibres for instance cotton fibres.

A small amount of binder may be added to improve the fixing of product P to the support; the amount is preferably less than 20% by weight compared with the total weight of product P. In case of a paste, the mixture usually has binders of waxy or oily nature.

The support is preferably made of board or rigid or semi-rigid plastic. The support may have various shapes; it preferably forms a tab with expanded end. Product P is then applied to the expanded tab end.

The support is kept in position in the print with edge to edge retention by a bead forming a recess at the print edge. The cradle/support assembly is covered preferably with peelable foil ensuring for the user that the support has not been removed from the cradle, and is thus unpolluted, also allowing better keeping of the product.

The cradle face bearing the print may be clad with a protection around the support; this protection may for instance be paper or plastic material bonded or applied to the cradle. The protection can be decorated, bear the product manufacturer's trademark or other information; the same cradle may contain several different protectors, allowing the same cradle to be used for different products.

This applicator assembly can be distributed as a sample and thrown away after use. Very thin assemblies can be made for use on supports such as magazines.

The above description given for the purposes of non-restrictive illustration, features two versions allowing easier comprehension of the invention.

DETAILED DESCRIPTION OF THE INVENTION

Figure 1:
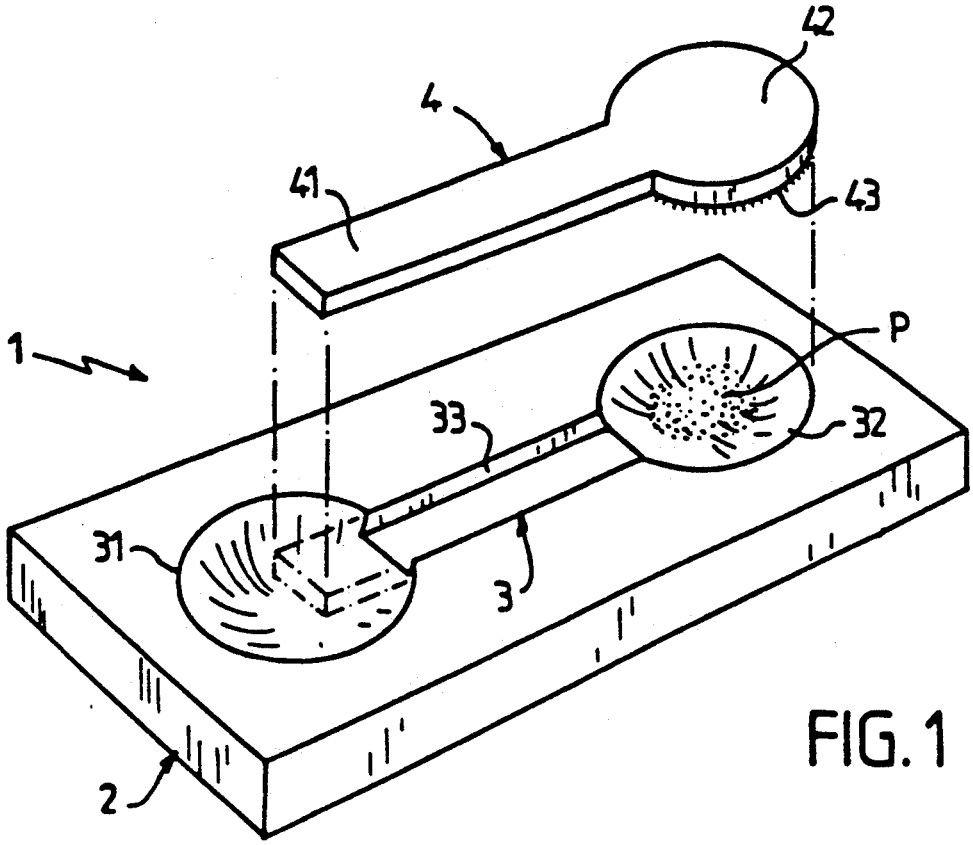
FIG. 1 is an applicator assembly according to the invention in course of assembly before compacting.

The assembly in FIG. 1 bears reference 1. It consists of a cradle 2 with a print 3. The support 4 is cut from a sheet of thinner board. There are two parts to it: an oblong 41 and a round pallet 42. The pallet 42 is flock-faced 43 on one side. The print 3 in cradle 2 is dumb-bell-shaped; it consists of two recesses 31 and 32 linked by an oblong groove 33. The width of oblong groove 33 is such that the oblong 41 of support 4 can be inserted therein edge to edge. Its depth is also such that when oblong 41 is placed in the groove 33, the outer face of oblong 41 is at the level of the surface of cradle 2. The edge dimensions of recess 32 are also such that the pallet 42 fits inside edge to edge. The depth of the print recess 32 exceeds the thickness of the support 4, so as to contain a powder or paste product P.

Recess 31 is of the same dimensions as recess 32. It is arranged so that after assembly, part of the oblong 41 of support 4 locates in the said recess 31, as shown by the mixed lines in FIG. 1.

Figure 2:
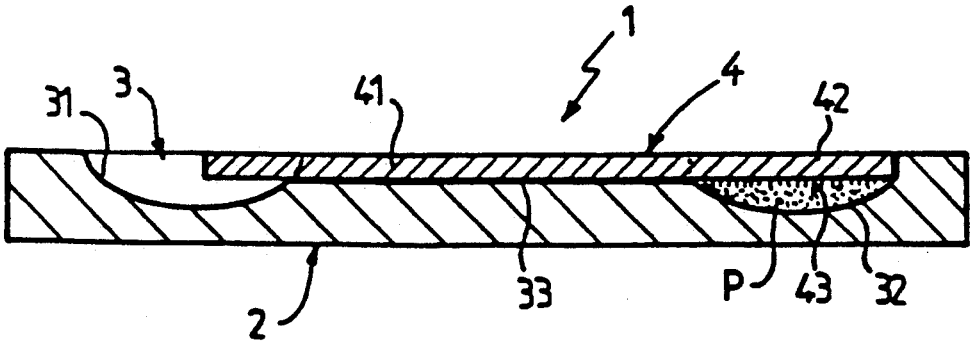
FIG. 2 represents a longitudinal section through the assembly in FIG. 1 after compacting.

To manufacture assembly 1, the print 32 is filled with product P to be affixed; in the case of a pasty product P, it can be poured into the print in the molten state, i.e. still hot. The support 4 is then placed on the print 3 of cradle 2, so that the face 43 bearing the flock of pallet 42 of support 4 faces towards the product P contained in recess 32. The assembly 1 is then placed on a platten, the support facing outwards. Using a moving press tool, a pressure of approx. 40 bars is exerted for 10 seconds on assembly 1 carried by the platten formed by the press fixed tool. Under this pressure the support 4 is pressed into the recess 3 and adjusted edge to edge in oblong channel 33 and in the recess 32 of the print. The major part of the product P contained in the recess 32 is secured to the flock 43 on pallet 42. An assembly 1 is thus obtained (see FIG. 2) containing a small amount of product P, the assembly then being suitable for distribution as a sample.

To test product P, support 4 is lifted from its recess 3 with a finger under oblong 41 of recess 31. Product P on flock 43 of support 4 is then applied. On completing the application, the support 4 and cradle 2 can be thrown away.

Figure 3:
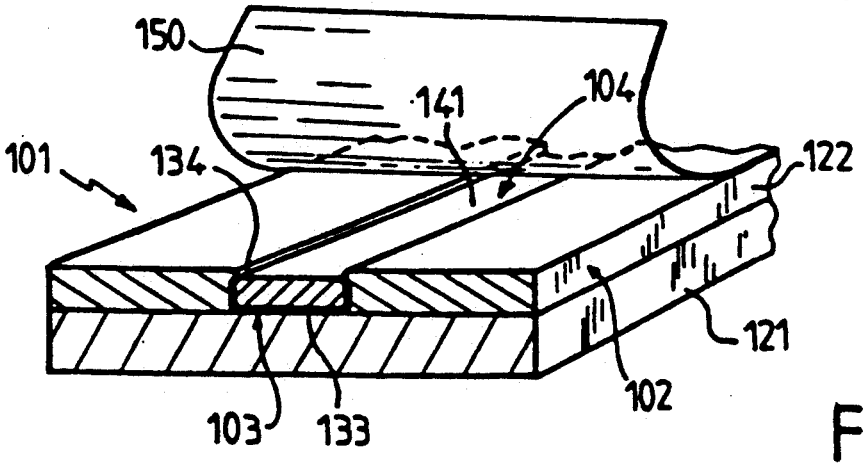
FIG. 3 represents a cross section of another version of the assembly according to the invention.

FIG. 3 shows the variation on the applicator assembly design 101: the cradle 102 of the assembly 101 consists of two sheets of board 121, 122 bonded to each other. The sheet 122 is cut to form a print 103 with edges having a bead 134 clipping in position the oblong 141 of support 104. The upper face of the cradle 102 / support 104 assembly is covered with a peelable foil 150, which must naturally be removed before extracting the support 104.

The peelable foil 150 ensures a measure of safety and shows the user that the support 104 has never been removed from the cradle 102 before use, and that the support 104 is consequently not polluted; the peelable foil 150 also allows improved keeping of product P.

I claim:

1. An applicator assembly with a powder or paste makeup product comprising a cradle including a receiving means having a groove having one end and an opposite end, a recess at said one end, an applicator comprising a stem having at one end thereof a pallet, a product deposited in said recess with said pallet being secured to at least a portion of said product pressure and said stem being located in said groove, said receiving means having a lifting recess located at said opposite end of said groove with a portion of said stem extending into said lifting recess.

2. An applicator assembly with a powder or paste makeup product comprising a cradle comprising a flat plate having a face, a receiving means impressed in said face and including a groove having one end and an opposite end, a recess at said one end, an applicator comprising a stem having at one end thereof a pallet, a product deposited in said recess with said pallet being secured to at least a portion of said product by pressure and said stem being located in said groove, said recess having a depth that is greater than the depth of said groove.

3. The invention as claimed in claim 1 or 2 wherein said pallet is at least partially flock-faced.

4. The invention as claimed in claim 1 or 2 wherein said cradle is made of a non-metallic material.

5. The applicator as claimed in claim 4 wherein said cradle is made from a cardboard material.

6. The invention as claimed in claim 4 wherein said cradle is made from a plastic material.

7. The invention as claimed in claim 5 wherein said receiving means is formed by bonding at least two sheets of cardboard together one of said cardboards being cut out to form said receiving means.

8. The invention as claimed in claim 1 or 2 wherein said product contains an amount of binder below 20 percent by weight compared with the overall weight of the product.

9. The invention as claimed in claim 1 or 2 wherein said applicator is made of non-metallic material.

10. The invention as claimed in claim 9 wherein said material is cardboard.

11. The invention as claimed in claim 9 wherein said material is plastic.

12. The invention as claimed in claim 1 or 2 wherein said cradle and groove are covered with a peelable foil.

13. The invention as claimed in claim 1 or 2 wherein said groove is provided with a lip whereby said stem of said applicator is secured in said groove by clipping under said lip.

14. The invention as claimed in claim 1 or 2 wherein said cradle having a face in which said groove is formed said face being covered with a protective covering surrounding said applicator.

15. A process for manufacturing a powder or paste make-up product applicator assembly which is of the type comprising a stem having one end provided with a pallet on which the product is secured by pressure, comprising the steps of using a cradle in the form of a plate having a face, impressing on said face means for receiving an applicator with said means for receiving including a groove for receiving the stem and a recess for receiving the pallet of an applicator with said recess having a depth greater than the depth of said groove, depositing the product in a part of said recess, placing the pallet in the recess with the stem in the groove, applying pressure to the assembly to urge at least said pallet of said assembly against the product to secure at least some of the product to said pallet.

16. An applicator assembly with a powder or paste makeup product comprising a cradle made from cardboard material and including receiving means, said receiving means having a groove having one end and a recess at said one end, an applicator comprising a stem having at one end thereof a pallet, a product deposited in said recess with said pallet being secured to at least a portion of the product by pressure and said stem being located in said groove of said cradle, said receiving means being formed by bonding at least two sheets of cardboard together, one of said cardboard sheets being cut out to form said receiving means.

17. The invention as claimed in claim 16 wherein said receiving means has a lifting recess.

* * * * *